US005377517A

United States Patent [19]

Kato

[11] Patent Number: 5,377,517

[45] Date of Patent: Jan. 3, 1995

[54] REFORMING APPARATUS

[75] Inventor: Heizaburo Kato, Shizuoka, Japan

[73] Assignee: Sankyo Seisakusho Co., Tokyo, Japan

[21] Appl. No.: 149,452

[22] Filed: Nov. 9, 1993

[51] Int. Cl.[6] ..... B21D 1/02

[52] U.S. Cl. ..... 72/164; 72/160

[58] Field of Search ..... 72/160–165

[56] References Cited

U.S. PATENT DOCUMENTS

| | | | |
|---|---|---|---|
| 2,252,085 | 8/1941 | Maussnest | 72/165 |
| 2,318,160 | 5/1943 | Johnson | 72/165 |
| 2,698,043 | 12/1954 | Holtz | 72/163 |

FOREIGN PATENT DOCUMENTS

| | | | |
|---|---|---|---|
| 446676 | 2/1948 | Canada | 72/163 |
| 344057 | 10/1904 | France | 72/162 |
| 863335 | 1/1953 | Germany | 72/163 |
| 883733 | 7/1953 | Germany | 72/160 |
| 3803394 | 8/1989 | Germany | 72/164 |
| 137627 | 6/1986 | Japan | 72/160 |

*Primary Examiner*—Daniel C. Crane
*Attorney, Agent, or Firm*—Darby & Darby

[57] ABSTRACT

There is disclosed apparatus for reforming a work material into a flat configuration. A pair of first and second sprockets are mounted respectively on a drive shaft and a driven shaft disposed parallel relation to each other, the pair of sprockets being rotatable at the same speed. A first endless belt includes a plurality of first reforming rolls rotatably supported at their opposite ends by opposed first endless chains. A second endless belt includes a plurality of second reforming rolls rotatably supported at their opposite ends by opposed second endless chains. The first and second sprockets are engaged respectively with the first and second reforming rolls to move the first and second endless belts, respectively, and the first and second reforming rolls are brought into frictional rolling engagement respectively with opposed first and second support plates provided respectively in the first and second endless belts. The work material introduced into a housing through an inlet is passed between the opposed first and second reforming rolls, thereby reforming the work material into a flat configuration. With this construction, the reforming apparatus achieves a high flatness precision, and can be of a compact size, and is not expensive.

6 Claims, 3 Drawing Sheets

REFORMING APPARATUS

BACKGROUND OF THE INVENTION

This invention relates to a reforming apparatus for correcting a bend or warp in a work material to thereby reform it into a flat configuration, the reforming apparatus being used in combination with a pressing operation or the like.

A conventional reforming apparatus of the type described comprises a pair of upper and lower rows (usually, several to several tens) of reforming rolls arranged in staggered relation to each other, and these reforming rolls are driven to be rotated at the same speed to pass a work material (e.g. a material for a coil) through the upper and lower rows of rolls, so that the work material is repeatedly bent or deformed during the passage of the work material from an inlet side to an outlet side, thereby achieving a flatness precision required for the product.

The arrangement, pitch, diameter, number and etc., of the reforming rolls are determined by the thickness, width, yield point and etc., of the work material. Generally, the larger the number of the rolls with a smaller diameter is, the higher the accuracy of reforming is. However, in the manufacture of the apparatus, as a space for a bearing for the roll is reduced, the bearing load capacity is lowered, and also the allowable torque reduction of the roll shaft and a drive mechanism is limited, and therefore the increase of the number of the rolls is limited. Therefore, depending on the working accuracy required for the material, the diameter and number of the rolls are determined, taking the manufacturing cost into consideration.

In such a conventional reforming apparatus, however, since the material is repeatedly bent, the roll has sometimes been flexed, which adversely affects the flatness precision. In order to prevent such a flexing of the roll, there has been proposed an apparatus in which upper and lower rows of rolls are supported by back-up rolls, respectively. However, such an apparatus suffers from a problem that it is complicated in construction, and has an increased size.

SUMMARY OF THE INVENTION

With the above problems of the prior art in view, it is an object of this invention to provide a reforming apparatus which enhances the precision of flatness of a reformed material, and is of a compact size, and is not expensive.

According to the present invention, there is provided a reforming apparatus for reforming a work material into a flat configuration, comprising:

a drive shaft;

a first gear fixedly mounted on the drive shaft;

a first sprocket fixedly mounted on the drive shaft;

a driven shaft disposed parallel to the drive shaft;

a second gear which is fixedly mounted on the driven shaft, and is in mesh with the first gear for rotation at the same speed as that of the first gear in a direction opposite to that of the first gear;

a second sprocket fixedly mounted on the driven shaft for rotation at the same speed as that of the first sprocket in a direction opposite to that of the first sprocket, teeth of the second sprocket being displaced half a pitch with respect to teeth of the first sprocket;

a first endless belt comprising a pair of parallel, opposed first endless chains, and a plurality of first reforming rolls rotatably supported at their opposite ends by the pair of endless chains, the teeth of the first sprocket being meshingly engageable with the plurality of reforming rolls to move the first endless belt;

a second endless belt comprising a pair of parallel, opposed second endless chains, and a plurality of second reforming rolls rotatably supported at their opposite ends by the pair of second endless chains, the teeth of the second sprocket being meshingly engageable with the plurality of second reforming rolls to move the second endless belt;

a first support plate provided in the first endless belt, the plurality of first reforming rolls being frictionally engageable with an outer periphery of the first support plate so that the first reforming rolls can roll on the first support plate;

a second support plate provided in the second endless belt in parallel opposed relation to the first support plate, the plurality of second reforming rolls being frictionally engageable with an outer periphery of the second support plate so that the second reforming rolls can roll on the second support plate; and means for adjusting the position of the first support plate with respect to the second support plate;

wherein the first and second reforming rolls are brought into opposed relation to each other at a region between the first and second support plates, and the work material is passed between these opposed first and second reforming rolls to be reformed into a flat configuration.

The teeth of the second sprocket are displaced half a pitch with respect to the teeth of the first sprocket, and the two sprockets are rotated at the same speed, so that the opposed first and second reforming rolls are kept in staggered relation to each other, and frictionally roll on the first and second support plates, respectively. Therefore, the work material passed between the opposed first and second reforming rolls is repeatedly bent, thereby removing a warp or bend from the work material.

DESCRIPTION OF THE PREFERRED EMBODIMENT

Figure 1:
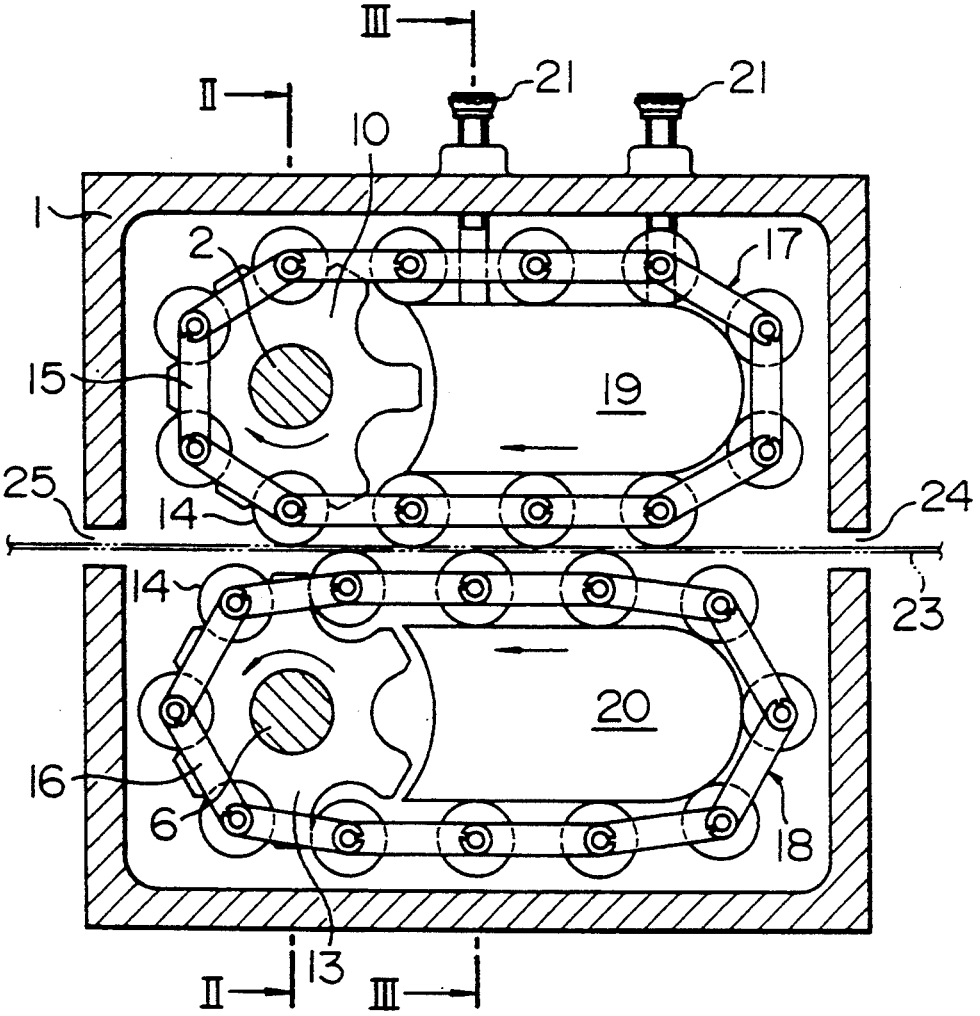
FIG. 1 is a cross-sectional view of one preferred embodiment of a reforming apparatus of the present invention.
Figure 2:
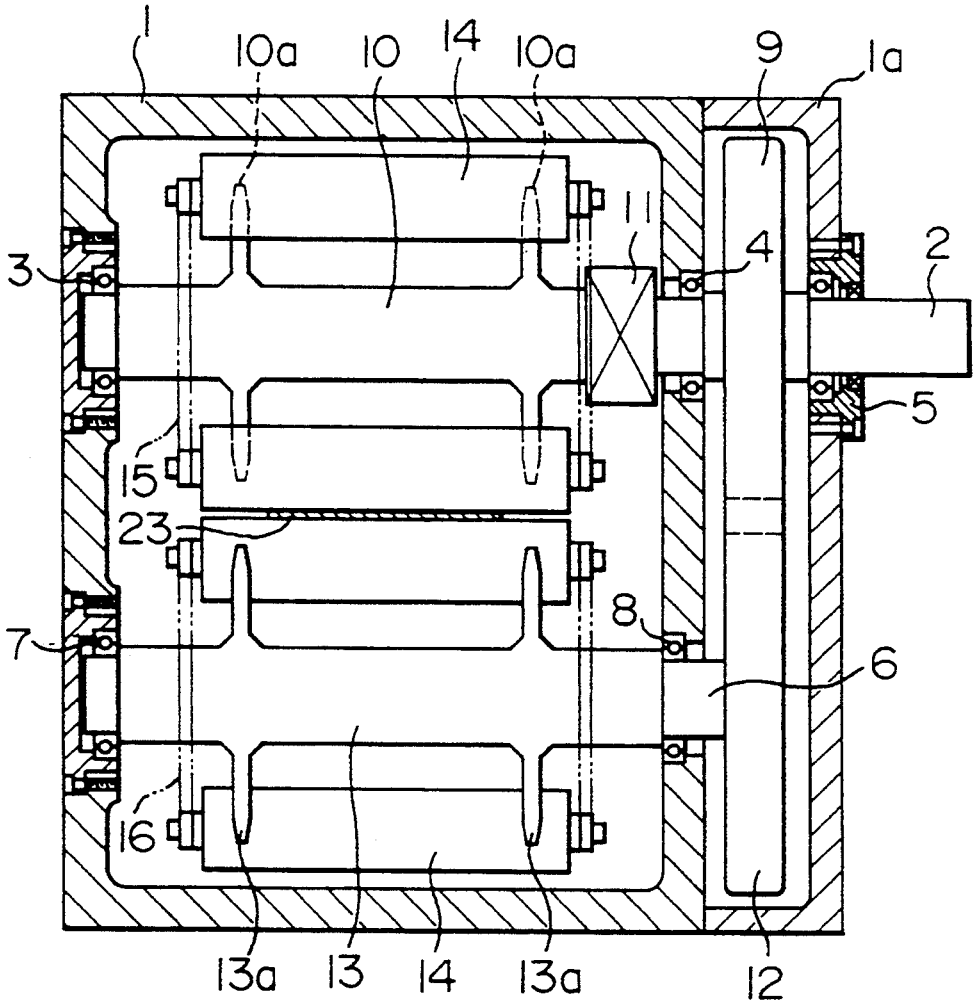
FIG. 2 is a cross-sectional view taken along the line II—II of FIG. 1.
Figure 3:
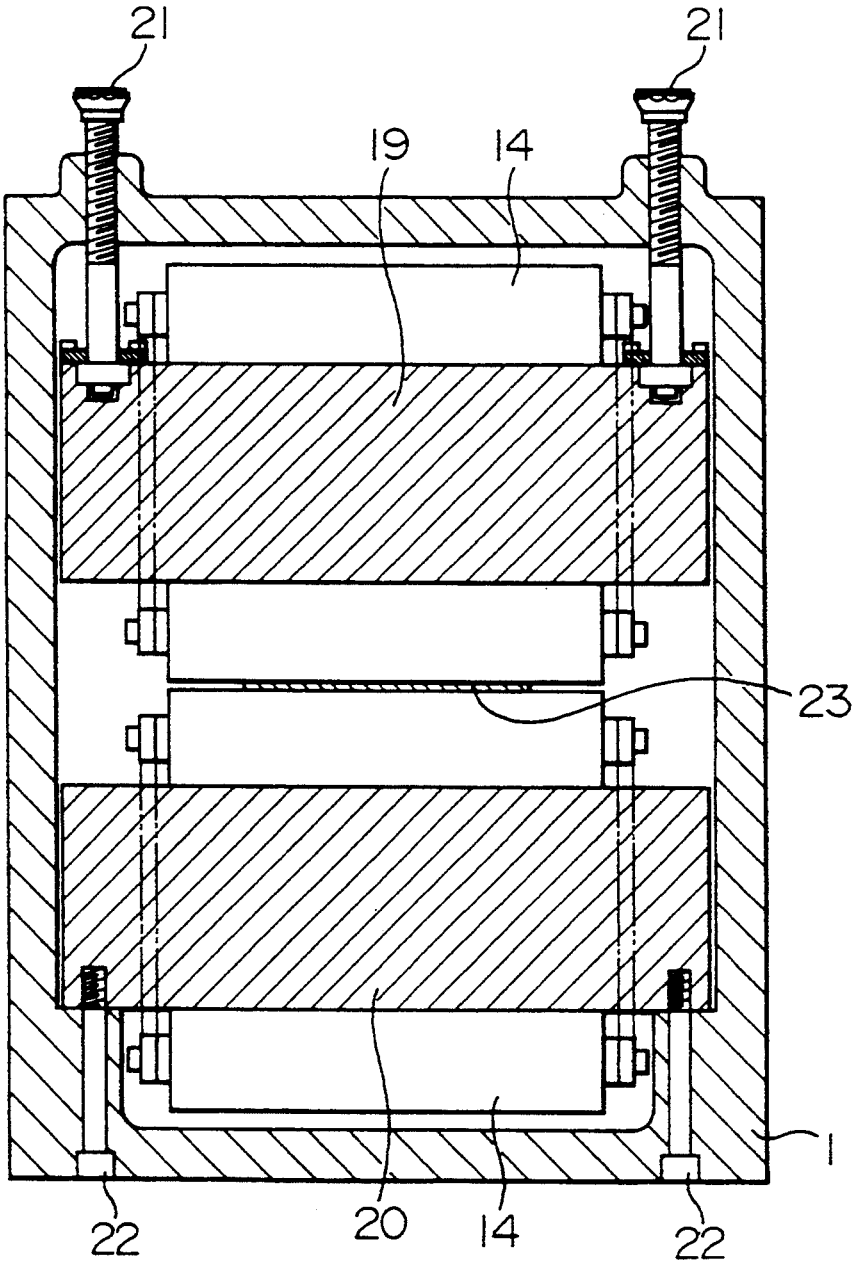
FIG. 3 is a cross-sectional view taken along the line III—III of FIG. 1.

FIGS. 1 to 3 show a reforming apparatus provided in accordance with the present invention. The reforming apparatus comprises a housing 1, and a gear casing 1*a* mounted on one side of the housing 1. A drive shaft 2 is rotatably mounted in the housing 1 through bearings 3 and 4, and is also rotatably supported on the gear casing 1*a* through a bearing 5. A driven shaft 6 is rotatably mounted in the housing 1 through bearings 7 and 8, the driven shaft 6 being parallel to the drive shaft 2. A first gear 9 and a first sprocket 10 are disposed within the gear casing 1*a* and the housing 1, respectively, and are fixedly mounted on the drive shaft 2. The first sprocket 10 is connected to the drive shaft 2 through a coupling 11. A second gear 12 and a second sprocket 13 are disposed within the gear casing 1*a* and the housing 1, respectively, and are fixedly mounted on the driven shaft 6. The second gear 12 and the second sprocket 13 are identical in size and shape to the first gear 9 and the first sprocket 10, respectively. The second sprocket 13 is fixedly mounted on the driven shaft 6 in such a manner that teeth 13*a* of the second sprocket 13 are displaced half a pitch with respect to teeth 10*a* of the first sprocket 10.

The first sprocket 10 has a pair of parallel spaced gear portions each having the teeth 10*a*, and similarly the second sprocket 13 has a pair of parallel spaced gear portions each having the teeth 13*a*. A plurality of reforming rolls 14 are rotatably supported at their opposite ends on a pair of parallel opposed endless chains 15 to form a first endless belt 17. Similarly, a plurality of reforming rolls 14 are rotatably supported at their opposite ends on a pair of parallel opposed endless chains 16 to form a second endless belt 18. The reforming rolls 14 of each of the first and second endless belts 17 and 18 are arranged at the same pitch as the pitch of the teeth 13*a*, 14*a* of the sprockets 13 and 14. A tooth valley portion between any two adjacent teeth 10*a*, 13*a* of each of the first and second sprockets 10 and 13 is formed into a curved surface whose radius of curvature is slightly larger than the radius of the reforming roll 14. A first support plate 19 is provided in the first endless belt 17, and one end of the first support plate 19 close to the first sprocket 10 is concavely curved whereas the other end thereof around which the first endless belt 17 is extended is convexly curved. A radius of curvature of the concave and convex ends of the first support plate 19 is substantially the same as the radius of the first sprocket 19. That portion of the first support plate 19 lying between the opposite curved ends thereof has a uniform thickness. In other words, the first support plate 19 has upper and lower flat surfaces disposed parallel to each other. Similarly, a second support plate 20 is provided in the second endless belt 18, and is disposed in parallel opposed relation to the first support plate 19. The second support plate 20 has opposite ends curved concavely and convexly, respectively, and has upper and lower parallel, flat surfaces, as described above for the first support plate 19. The first support plate 19 is mounted on a top wall of the housing 1 by four set screws 21 for vertical movement toward and away from the second support plate 20. The second support plate 20 is fixedly mounted on the bottom of the housing 1 by four screws 22. The housing 1 has an inlet 24 and an outlet 25 formed respectively through opposite side walls thereof. The inlet 24 and the outlet 25 are disposed at a common horizontal plane in which the lower portion of the first endless belt 17 and the upper portion of the second endless belt 18 are disposed in opposed relation to each other. A work material (sheet material) 23 is introduced into the housing 1 through the inlet 24, and is discharged therefrom through the outlet 25.

The operation of this reforming apparatus will now be described. First, the spacing of the first support plate 19 from the second support plate 20 is so adjusted by the set screws 21 that the opposed reforming rolls 14 of the first and second endless belts 17 and 18, disposed in a staggered manner along the path of travel of the work material 23 within the housing 1, can bend or deform the work material 23 in such a manner that the degree of deformation or bending of the work material 23 is decreasing progressively from the inlet side 24 toward the outlet side 25, and is finally reduced to zero. In this condition, when the drive shaft 2 is rotated, a rotational force is transmitted through the first and second gears 9 and 12 (whose gear ratio is 1:1) to the driven shaft 6, so that the first and second sprockets 10 and 13 rotate in opposite directions at the same speed. As a result, the two sprockets 10 and 13 move the opposed portions (that is, the opposed reforming rolls 14) of the two endless belts 17 and 18 in the same direction, and the opposed reforming rolls 14 of these endless belts 17 and 18 roll respectively on the first and second support plates 19 and 20 by friction. Therefore, the work material 23 introduced into the housing 1 through the inlet 24 is fed by these opposed, staggered reforming rolls 14 toward the outlet 25, and at the same time is reformed into a flat configuration. Here, there is established a formula, $V=2V_0$, where V represents the speed of feed of the work material 23, and $V_0$ represents the speed of movement of the endless belts 17 and 18. This is achieved because the opposed reforming rolls 14 rotate about their axis through the frictional contact with their respective support plates 19 and 20.

Thus, in this embodiment, since the reforming rolls 14 of the first and second endless belts 17 and 18 are brought into frictional rolling engagement with their respective support plates 19 and 20, and therefore are rotated about their axis, the provision of a power transmission system for rotating the reforming rolls (which system has heretofore been required) is omitted. This enables a compact construction of the reforming apparatus, and also reduces the cost. The reforming rolls 14 are supported on the support plates 19 and 20, and structurally, the rigidity of the support plates 19 and 20 can be increased regardless of the size thereof. Therefore, the support plates 19 and 20 serve to back up the rigidity of the reforming rolls 14 in the direction of compression of these reforming rolls, and therefore suppress the flexing of the reforming rolls 14, thereby enhancing the flatness precision of the reformed work material 23. Since the reforming rolls 14 are rotatably supported on the chains 15, 16 to form the endless belt 17, 18, bearings and other associated parts are not needed. Therefore, the number of reforming rolls 14 per unit length can be increased by decreasing the diameter of the reforming rolls 14. This enhances the flatness precision. Furthermore, the reforming apparatus capable of achieving the required flatness precision of the product can be of a smaller size than the conventional apparatuses. Therefore, when this reforming apparatus is installed in a pressing line, the space required for this apparatus, as well as the line length, is reduced, so that the efficiency of the production per unit area of the plant or factory is enhanced.

As described above, each group of reforming rolls are rotatably supported at their opposite ends by the pair of opposed endless chains to form a respective one of the first and second endless belts, and these endless belts are driven respectively by the first and second sprockets in mesh with the reforming rolls, and each group of reforming rolls are brought into frictional rolling engagement with a respective one of the first and second support plates provided respectively in the first and second endless belts. The work material is passed between the opposed reforming rolls of the first and second endless belts to be reformed into a flat configuration. The reforming apparatus of this construction achieves a high flatness precision, and can be compact in size, and is not expensive.

What is claimed is:

1. Apparatus for reforming work material into a flat configuration, comprising:

a drive shaft;

a first gear fixedly mounted on said drive shaft;

a first sprocket fixedly mounted on said drive shaft;

a driven shaft disposed parallel to said drive shaft;

a second gear which is fixedly mounted on said driven shaft, and is in mesh with said first gear for rotation at the same speed as that of said first gear in a direction opposite to that of said first gear;

a second sprocket fixedly mounted on said driven shaft for rotation at the same speed as that of said first sprocket in a direction opposite to that of said first sprocket, teeth of said second sprocket being displaced half a pitch with respect to teeth of said first sprocket;

a first endless belt comprising a pair of parallel, opposed first endless chains, and a plurality of first reforming rolls rotatably supported at their opposite ends by said pair of endless chains, the teeth of said first sprocket being meshingly engageable with said plurality of reforming rolls to move said first endless belt;

a second endless belt comprising a pair of parallel, opposed second endless chains, and a plurality of second reforming rolls rotatably supported at their opposite ends by said pair of second endless chains, the teeth of said second sprocket being meshingly engageable with said plurality of second reforming rolls to move said second endless belt;

a first support plate provided in a space defined by said first endless belt, said plurality of first reforming rolls being frictionally engageable with an outer periphery of said first support plate so that said first reforming rolls can roll on said first support plate;

a second support plate provided in a space defined by said second endless belt in parallel opposed relation to said first support plate, said plurality of second reforming rolls being frictionally engageable with an outer periphery of said second support plate so that said second reforming rolls can roll on said second support plate; and means for adjusting the position of said first support plate with respect to said second support plate;

wherein said first and second reforming rolls are brought into opposed relation to each other at a region between said first and second support plates, and the work material is passed between these opposed first and second reforming rolls into a flat configuration, the first and second sprockets being located downstream of the first and second support plates, respectively, as viewed in the direction of movement of the work material, the first reforming rolls that are positioned upstream of the first sprocket making substantially continuous rolling contact with the outer periphery of the first support plate as the first reforming rolls move in a direction for travelling around the periphery of said first support plate, and the second reforming rolls that are positioned upstream of the second sprocket making substantially continuous rolling contact with the outer periphery of the second support plate as the second reforming rolls move in a direction for travelling around the periphery of said second support plate, said first reforming rolls meshingly engaging only with said first sprocket as they travel endlessly throughout an entire rotation of said first endless belt, said second reforming rolls meshingly engaging only with said second sprocket as they travel endlessly throughout an entire rotation of said second endless belt.

2. Apparatus according to claim 1, in which the spacing of said first support plate from said second support plate is so adjusted by said adjusting means that said opposed first and second reforming rolls, disposed in a staggered manner along a path of travel of the work material, can bend the work material in such a manner that the degree of bending of the work material is decreasing progressively as the work material is fed, and is finally reduced to zero.

3. Apparatus according to claim 1, further comprising a housing within which said first and second sprockets, said first and second endless belts, and said first and second support plates are mounted, said housing having an inlet and an outlet formed through a peripheral wall thereof, and said inlet and outlet being disposed in a common plane in which said first and second reforming rolls are disposed in opposed relation to each other, wherein the work material is introduced into said housing through said inlet, and is passed between said opposed first and second reforming rolls, and is discharged from said outlet.

4. An apparatus for reforming work material into a flat configuration, comprising:

two support plates each having a respective outer periphery surface portion in parallel opposed relation to each other;

first and second pluralities of rolls;

means for adjusting a relative position of said two support plates relative to each other;

first and second endless belts rotatably supporting said first and second pluralities of rolls, said first and second plurality of rolls frictionally engaging with and rolling on respective ones of said two support plates; and first and second driving means for driving said first and second endless belts at the same speed in opposite directions by engaging said first and second plurality of rolls, respectively, only downstream of said two support plates as viewed in a direction of movement of the work material travelling between said outer periphery surface portions of the two support plates, said first rolls meshingly engaging only with said first driving means as they travel endlessly throughout an entire rotation of said first endless belt, said second rolls meshingly engaging only with said second driving means as they travel endlessly throughout an entire rotation of said second endless belt.

5. An apparatus as in claim 4, wherein said first and second driving means each includes a sprocket meshingly engaging respective ones of said first and second plurality of rolls.

6. An apparatus as in claim 4, wherein said first and second driving means further includes two gears meshing with each other and dimensioned so that both rotate at the same speed in opposite directions, two drive shafts each in driving connection with a respective one of said two gears and rotatable therewith, said sprockets each being in driving connection with a respective one of said two drive shafts and rotatable therewith, said sprockets each having teeth with said teeth of one of said sprockets being displaced half a pitch relative to that of the other.

* * * * *